US006486571B1

(12) United States Patent
Miller et al.

(10) Patent No.: US 6,486,571 B1
(45) Date of Patent: Nov. 26, 2002

(54) POWER DELIVERY AND CONNECTION CIRCUIT FOR AN AUTOMOTIVE VEHICLE

(75) Inventors: John Michael Miller, Saline, MI (US); Paul Raymund Nicastri, Plymouth, MI (US)

(73) Assignee: Ford Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/683,913

(22) Filed: Mar. 1, 2002

(51) Int. Cl.[7] ..... H01H 3/26

(52) U.S. Cl. ..... 307/140; 307/10.7; 307/10.1; 307/139

(58) Field of Search ..... 307/139, 140, 307/10.7, 10.1

(56) References Cited

U.S. PATENT DOCUMENTS 3,739,192 A 6/1973 Oswald
3,755,635 A 8/1973 McGill
4,034,172 A * 7/1977 Glover et al. ..... 200/51.1
4,652,067 A * 3/1987 Lutzenberger ..... 339/18 P
5,309,114 A * 5/1994 Swanson ..... 320/10
5,332,958 A * 7/1994 Sloan ..... 320/13
5,369,540 A 11/1994 Konrad et al.
5,502,609 A 3/1996 Thomas et al.
5,822,185 A * 10/1998 Cavello ..... 361/686
5,940,000 A * 8/1999 Dykema ..... 340/825.22

* cited by examiner

*Primary Examiner*—Brian Sircus
*Assistant Examiner*—Robert L DeBeradinis
(74) *Attorney, Agent, or Firm*—Artz & Artz, P.C.; Carlos L. Hanze

(57) ABSTRACT

A circuit (10) for connecting a power distribution bus (14) to a battery (12) has a connector circuit (20) and a switch (40). The battery has a positive battery terminal (16) and a negative battery terminal (18). The switch (40) has a control terminal (46), a first terminal (42), and a second terminal (44). A contactor circuit (48) is coupled between the battery (12) and the power distribution bus (14). The contactor circuit (48) has a solenoid (50) and a plunger switch (52) that is operably coupled by solenoid (50). In one embodiment of the invention the connector circuit has a switch (38) used to allow the connector terminals to be coupled at different times to the circuit. In the second embodiment, different length terminals may be used to enable coupling of the battery terminals at different times.

12 Claims, 1 Drawing Sheet

POWER DELIVERY AND CONNECTION CIRCUIT FOR AN AUTOMOTIVE VEHICLE

BACKGROUND OF INVENTION

1. Technical Field

The present invention relates generally to power delivery systems for automotive vehicles, and more particularly, to a power delivery circuit used to prevent electrical arcing.

2. Background

In future automotive vehicles, 42-volt systems will replace or supplement 12-volt systems. Forty-two volt systems will be used to help meet the ever-increasing electrical demand of automotive vehicles. However, as voltage increases and current being conducted increases, the probability of arcing increases. Arcing can also be influenced by the types of loads being interrupted, for example, inductive capacitive or resistive.

The inventors herein have recognized a need to provide an electronic power distribution that minimizes the probability of arcing in a vehicle having a 42-volt system.

In addition, the inventors herein have recognized the need to provide an electrical architecture suitable for powering an integrated starter/generator while still allowing the use of 42 volt components.

SUMMARY OF THE INVENTION

The present invention provides an improved circuit for a power distribution system that includes a power distribution bus and a battery having a positive terminal and a negative terminal. A contactor circuit having a solenoid is operably coupled to a plunger switch. The solenoid has a first solenoid terminal and a second solenoid terminal. The plunger switch selectively couples the power distribution bus to the positive battery terminal. A switch having a first terminal, a second terminal and a control terminal is coupled to the second solenoid terminal. A connector matingly engages the positive battery terminal and the first solenoid terminal before the negative battery terminal is coupled to the second terminal of the switch. A controller is coupled to the control terminal of the switch to control the operation of the switch.

In a further aspect of the invention, a method for operating a circuit having a contactor that includes a solenoid and a plunger switch that is operatively coupled to the solenoid includes coupling a first connector portion to a second connector portion, and in response to coupling the first connector portion to the second connector portion, coupling a second terminal of a switch coupled to a solenoid to the negative battery terminal after coupling a positive battery terminal to a first terminal of the solenoid.

One advantage of the invention is that the switch of the circuit may be used for supervisory control by the controller and also as a theft deterrent, a safety shunt, or to reduce parasitic load on the battery when the vehicle is parked. By including a diode in the contactor switch reverse battery protection may also be provided by the circuit of the present invention.

Other advantages and features of the present invention will become apparent when viewed in light of the detailed description of the preferred embodiment when taken in conjunction with the attached drawings and appended claims.

DETAILED DESCRIPTION

Figure 1:
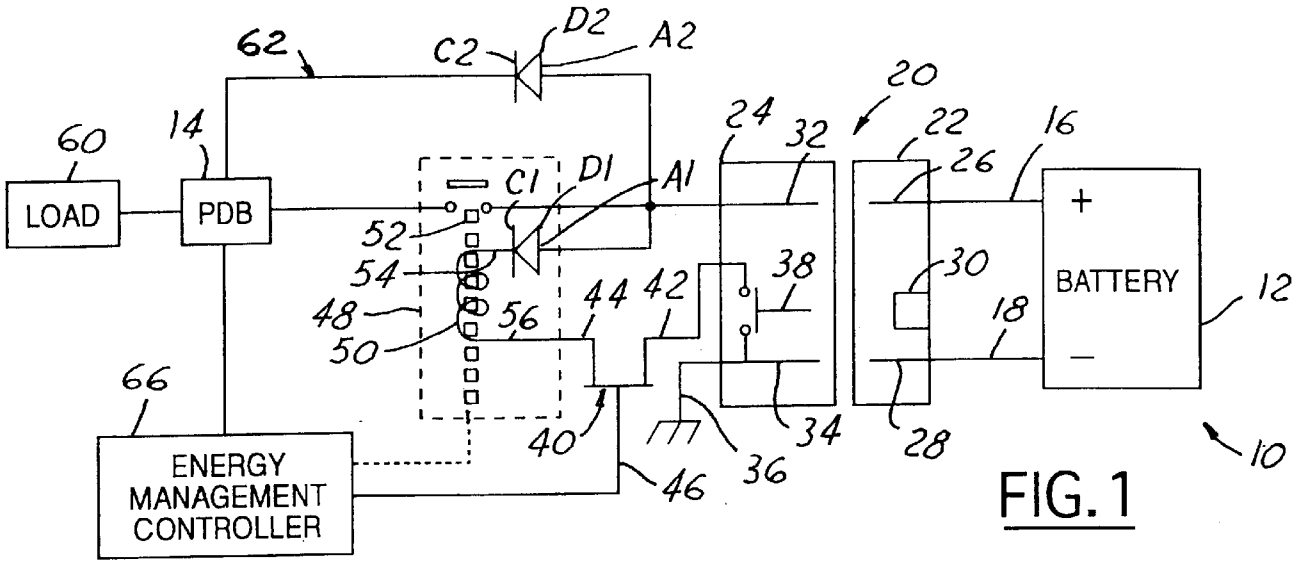
FIG. 1 is a schematic view of a first embodiment of the present invention.

In the following figures, the same reference numerals will be used to identify the same components. While the present invention is illustrated with respect to a contactor, other types of switching devices may be used in place of contactor. Also, the present invention is illustrated with respect to an automotive vehicle circuit. However, other high voltage direct current applications may also benefit from the teachings disclosed herein.

Referring now to FIG. 1, an electrical circuit 10 formed according to a first embodiment of the present invention is illustrated. Circuit 10 is used for electrically coupling a battery 12 to a power distribution bus (PDB) 14. Battery 12 has a positive battery terminal 16 and a negative terminal 18. Battery 12 is coupled to power distribution bus 14 through a connector 20. Connector 20 has a first housing portion 22 and a second housing portion 24. First housing portion 22 has a first terminal 26 and a second terminal 28 that are respectively coupled to first battery terminal 16 and negative battery terminal 18. First housing portion 22 may also have an engagement feature 30. Second housing portion 24 also has a first terminal 32 and a second terminal 34. First terminal 32 is used to electrically coupled to first terminal 26 of second housing portion and second terminal 34 is used to electrically coupled to second terminal 26. Those skilled in the art will recognize that either one of the sets of terminals within first housing portion 22 and second housing portion 24 may be male or female so that each of the sets of terminals engages. Second terminal 34 is preferably coupled to a ground such as chassis ground.

Second housing portion 24 may also include a switch 38 therein. Switch 38 is a normally open switch but when first housing portion 22 is brought together with second housing portion 24, engagement feature 30 is used to close switch 38.

When switch 38 is closed, second terminal 34 of second connector portion 24 is coupled to a switch 40. Switch 40 is preferably a solid state switch such as a transistor. Switch 40 has a first terminal 42, a second terminal 44, and a control terminal 46.

Switch 40 and more particularly second terminal 44 and first terminal 32 of second housing portion 24 are electrically coupled to a contactor circuit 48. Contactor circuit 48 has a solenoid 50 which electro magnetically operates a plunger switch 52. Plunger switch 52 electrically couples first terminal 32 of second housing portion 24 to power distribution bus 14.

Solenoid 50 has a first end 54 and a second end 56. First end 54 is electrically coupled to first terminal 32 of second connector portion 24. Preferably, a diode D1 is interposed between first end 54 and terminal 32 of second housing portion 24. Diode D1 is used to prevent the solenoid from coupling a reversed voltage/polarity battery terminals to the power distribution bus 14. Diode D1 has an anode A1 and a cathode C1. Preferably, cathode C1 is coupled to first end 54 while anode A1 is coupled to first terminal 32. Second end 56 is coupled to second terminal 44 of switch 40.

Power distribution bus 14 is coupled to a load 60. Load 60 may thus be connected and disconnected by operation of circuit 10. In addition, a portion of load 60 may also form a portion for a keep live circuit. Thus, not all of load 60 may be disconnected by circuit 10. To provide power for keep alive circuits, a bypass circuit 62 is included herewith. Bypass circuit 62 includes a coupling from first battery terminal 32 to power distribution bus 14 through a diode D2. Diode D2 has a cathode C2 coupled to power distribution bus 14 and an anode A2 electrically coupled to first terminal 32 of the second housing portion 24.

An energy management controller 66 may be coupled to power distribution bus 14, plunger switch 52, and control terminal 46 of switch 40. Energy management controller 66 is preferably a microprocessor-based controller used to provide supervisory control to the circuit. Energy management controller 66 is used to turn switch 40 on and off (conducting/non-conducting) through control terminal 46. In some situations it may be desirable to keep contactor plunger switch 52 open even when battery 12 is coupled. For example, this type of scenario may be suitable for theft deterrent, safety shunting, and to reduce parasitic loads on a parked vehicle.

Bypass circuit 62 is preferably a low current application. Reverse battery protection is provided by the orientation of diode D2. In operation, three levels of protection are provided for power distribution bus 14. The unmating and mating of first connector housing 22 and second connector housing 24 provide a first level of protection with the switch 38. Switch 38 allows mating/unmating of second terminal 28 of first housing portion 22 and thus negative battery terminal 18 to second terminal 34 of second connector housing 24 and first terminal 26 of first housing 22 and thus positive battery terminal 16 with first terminal 32 of second housing portion 24 while plunger switch 52 is open. By closing the switch 38 a return path is provided through switch 40 for the energy and contactor solenoid coil 50. Once engaged, solenoid coil operates to electro magnetically move plunger switch 52 so that engagement of power distribution bus with the positive battery terminal 16 through connector 20 is accomplished. When the switch is disconnected, switch 38 opens before terminals 32 and 26 are disconnected. Thus, plunger switch 52 will consequently open.

Figure 2:
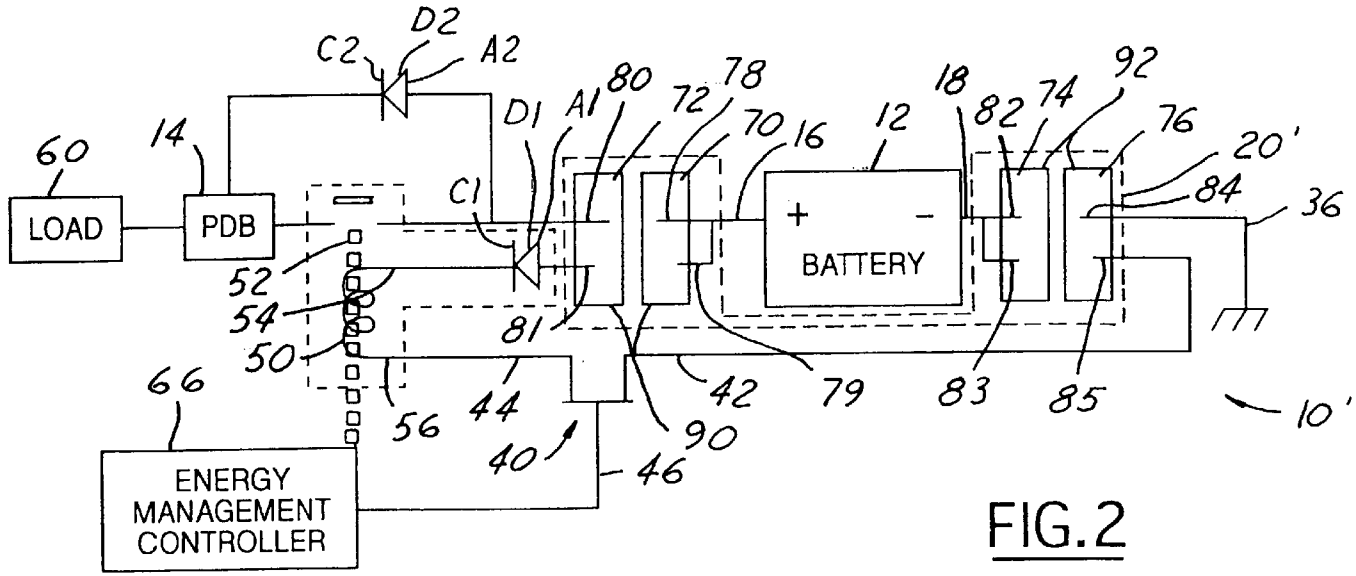
FIG. 2 is a schematic view of a second embodiment of the present invention.

Referring now to FIG. 2, a second embodiment of circuit 10"" is illustrated. In this embodiment, connector 20"" has been modified from connector 20 above. In this embodiment a terminal switch 38 is not employed but unequal length terminals are employed as will be described below. Connector circuit 20"" may be divided into two portions corresponding to the positive battery terminal 16 and the negative battery terminal 18. That is, a first positive terminal housing 70 and a second positive terminal housing 72 may be used to connect the positive battery terminal 16 to the power distribution bus 14. A first negative terminal housing 74 and a second negative terminal housing 76 may be used to connect the negative battery terminal 18 to switch 40. Although two separate portions are shown, one connector may be used to house both the positive battery terminal housing 70 and first negative terminal housing 74 and second positive terminal housing 72 and second negative terminal housing 76.

First positive terminal housing 70 has a first terminal 78 and a second terminal 79. Second positive terminal housing 72 has a first terminal 80 and a second terminal 81. First terminal 78 and second terminal 79 are electrically coupled together and coupled to positive battery terminal 16. As illustrated, first terminal 78 is longer than second terminal 79. First terminal 80 is coupled to plunger switch 52 and diode D2. Second terminal 81 of housing 72 is coupled to first end 54 of solenoid 50 through diode D1. Preferably, terminal 81 is shorter than terminal 80. The size of at least one of the terminals 79 or 81 is chosen to be smaller than the others to allow terminals 78 and 80 to be coupled together before terminals 81 and 79. This will prevent the arcing of the terminals upon connection.

Likewise, terminals 82 and 83 are coupled to negative battery terminal 18. Terminal 83 is preferably shorter than terminal 82 for the same reason terminals 81 and 79 are shorter than terminals 80 and 78. Terminal 84 is coupled to chassis ground 36 and terminal 85 is coupled to first terminal 42 of switch 40. At least one of terminals 83, 85 are shorter than terminals 82 and 84 to allow terminals 82 and 84 to be coupled together before terminals 83 and 85.

In operation, terminals 78 and 82 are preferably coupled together with terminals 80 and 84 before terminals 79 and 83 are coupled together with terminals 81 and 85. Within each connector portion, terminals 81 and 79 are preferably coupled together after terminals 80 and 78 while terminals 83 and 85 are coupled together after terminals 82 and 84. Latching mechanisms 90, 92 may also be used to slow the decoupling process to allow the coil 50 time to energize/de-energize. That is, by slowing the coupling or decoupling process, the desired electrical results through solenoid 50 may be obtained.

While particular embodiments of the invention have been shown and described, numerous variations and alternate embodiments will occur to those skilled in the art. Accordingly, it is intended that the invention be limited only in terms of the appended claims.

What is claimed is:

1. A circuit comprising:

a power distribution bus;

a battery having a positive terminal and a negative terminal;

a contactor circuit having a solenoid operably coupled to a plunger switch, said solenoid having a first solenoid terminal and a second solenoid terminal, said plunger switch selectably coupling said power distribution bus to said positive battery terminal;

a switch having a first terminal, a second terminal and a control terminal, said first terminal coupled to said second solenoid terminal;

a connector circuit matingly engaging said positive battery terminal and said first solenoid terminal before said negative battery terminal is coupled to said second terminal of said switch; and a controller coupled to said control terminal of said switch, said controller controlling said switch.

2. A circuit as recited in claim 1 wherein the switch comprises a transistor.

3. A circuit as recited in claim 1 wherein said connector circuit comprises a first connector housing and a second connector housing for matingly engaging said first connector housing, said first housing having a first conductor and a second conductor, said second connector housing having a third conductor coupled to said positive battery terminal a fourth conductor coupled negative battery terminal.

4. A circuit as recited in claim 1 wherein said connector circuit comprises a first positive terminal housing having a first terminal and a second terminal, a second positive terminal housing having a first terminal and a second terminal, a first negative terminal housing having a first terminal and a second terminal and a second negative terminal housing having a first terminal and a second terminal.

5. A circuit as recited in claim 4 wherein said first terminal of said first positive terminal housing is longer than said second terminal of said first positive terminal housing.

6. A circuit as recited in claim 4 wherein said first terminal of said first negative terminal housing is longer than said second terminal of said first positive terminal housing.

7. A circuit as recited in claim 1 wherein said further comprising a bypass circuit coupled between said connector circuit and said power distribution bus.

8. A circuit as recited in claim 1 wherein said wherein said bypass circuit comprises a diode having an anode coupled to said connector circuit and an cathode coupled to said power distribution bus.

9. A circuit as recited in claim 1 wherein said contactor circuit comprises a diode coupled to said solenoid for reverse battery protection.

10. A method of operating a circuit having a contactor having a solenoid and a plunger switch operatively coupled to the solenoid comprising:

coupling a first connector portion to a second connector portion;

in response to coupling said first connector portion to said second connector portion coupling a second terminal of a switch coupled to a solenoid to the negative battery terminal after coupling a positive battery terminal to a first terminal of the solenoid.

11. A method as recited in claim 10 further comprising controlling the plunger switch to electrically couple a power distribution bus to the positive battery terminal after the coupling of the switch.

12. A method as recited in claim 10 further comprising coupling a second terminal of a switch coupled to a solenoid to the negative battery terminal after coupling a positive battery terminal to a first terminal of the solenoid.

* * * * *